US006736613B2

(12) United States Patent
Nagata

(10) Patent No.: US 6,736,613 B2
(45) Date of Patent: May 18, 2004

(54) ACCELERATION FUEL PUMP HAVING A RESILIENT CHECK VALVE MEMBER FOR A COMBUSTION ENGINE CARBURETOR

(75) Inventor: Noriyu Nagata, Miyagi-ken (JP)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 10/140,051

(22) Filed: May 7, 2002

(65) Prior Publication Data

US 2002/0176789 A1 Nov. 28, 2002

(30) Foreign Application Priority Data

May 18, 2001 (JP) ..... 2001-149268

(51) Int. Cl.[7] ..... F04B 35/04

(52) U.S. Cl. ..... 417/415; 137/102; 137/512.4; 123/567; 123/566; 417/443; 417/560; 417/570

(58) Field of Search ..... 137/102, 512.4; 123/560, 567, 566; 417/261, 443, 415, 481, 484, 560, 570

(56) References Cited

U.S. PATENT DOCUMENTS

| | | | | | |
|---|---|---|---|---|---|
| 2,912,999 | A | * | 11/1959 | Kersh | 137/512.4 |
| 3,604,451 | A | * | 9/1971 | Delamater | 137/512.15 |
| 3,664,774 | A | * | 5/1972 | Tupper et al. | 417/560 |
| 3,788,615 | A | * | 1/1974 | Bishop | 261/34.2 |
| 4,084,606 | A | * | 4/1978 | Mittleman | 137/102 |
| 4,278,618 | A | * | 7/1981 | Higashigawa et al. | 261/34.2 |
| 4,824,337 | A | * | 4/1989 | Lindner et al. | 417/417 |
| 4,832,582 | A | * | 5/1989 | Buffet | 417/413.1 |
| 5,237,309 | A | * | 8/1993 | Frantz et al. | 340/679 |
| 5,301,707 | A | | 4/1994 | Hofsteenge | 173/12 |
| 5,305,777 | A | * | 4/1994 | Nakamura et al. | 137/102 |
| 6,293,524 | B1 | | 9/2001 | Endo et al. | 261/34.2 |

* cited by examiner

*Primary Examiner*—Justine R. Yu
*Assistant Examiner*—Emmanuel Sayoc
(74) *Attorney, Agent, or Firm*—Reising, Ethington, Barnes, Kisselle, P.C.

(57) ABSTRACT

An acceleration fuel pump for use with a combustion engine carburetor is an integral part of the carburetor body and provides an additional flow of fuel to the fuel-and-air mixing passage of the carburetor during acceleration of the engine. The acceleration fuel pump has a plunger which inserts sealably into a cylindrical cavity carried by the body of the carburetor. During acceleration of the engine, the plunger inserts further into the cavity against the resilient force of a spring and toward a resilient check valve member causing the member to deform into a fuel feed state. A fuel passage which extends between the bottom of a fuel chamber of the carburetor and the fuel-and-air mixing passage of the carburetor is intersected by the cavity and the resilient check valve member. The member has a slit at a leading portion of the member which opens when in the fuel feed state and fuel is pushed by the plunger out of a fuel reservoir carried by the cavity and into an outlet leg of the fuel feed passage which supplies fuel to the fuel-and air-mixing passage. During insertion of the plunger, pressure within the fuel reservoir overcomes the pressure within the fuel chamber causing a trailing segment of the member to expand radially outward and engage the internal cylindrical wall of the cavity preventing any reverse flow from the fuel reservoir and into an inlet leg of the fuel passage which extends from the cavity to the fuel chamber. When the engine is through acceleration, the plunger insertion stops and the internal spring forces the plunger retract in an outward direction from the cavity. This retraction causes a pressure reduction within the fuel reservoir causing the slit of the leading segment of the check valve member to close and the peripheral rim of the trailing segment to separate or space from the cylindrical wall of the cavity. Fuel is then drawn from the fuel chamber through the inlet leg of the fuel passage into the fuel reservoir in preparation for the next acceleration of the combustion engine.

18 Claims, 2 Drawing Sheets

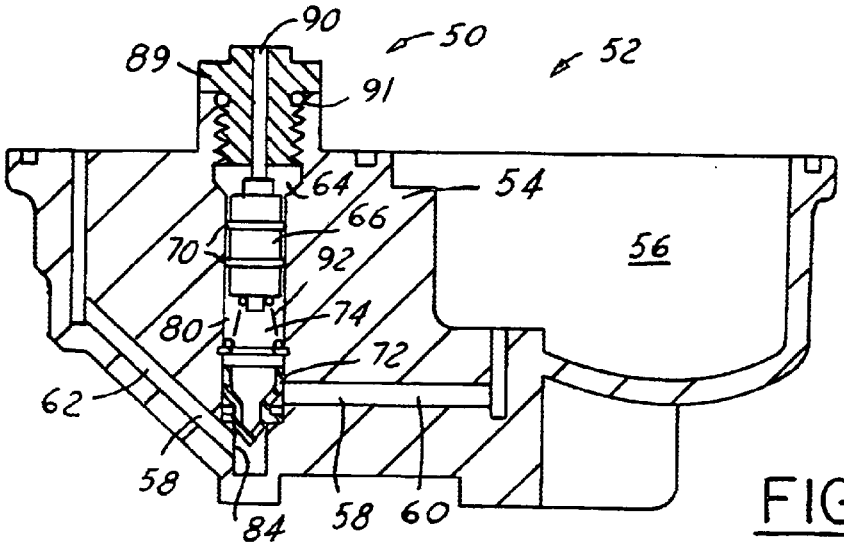
FIG. 1
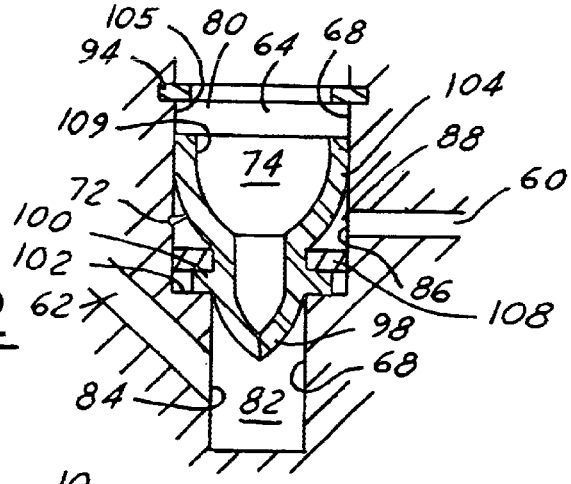
FIG. 2
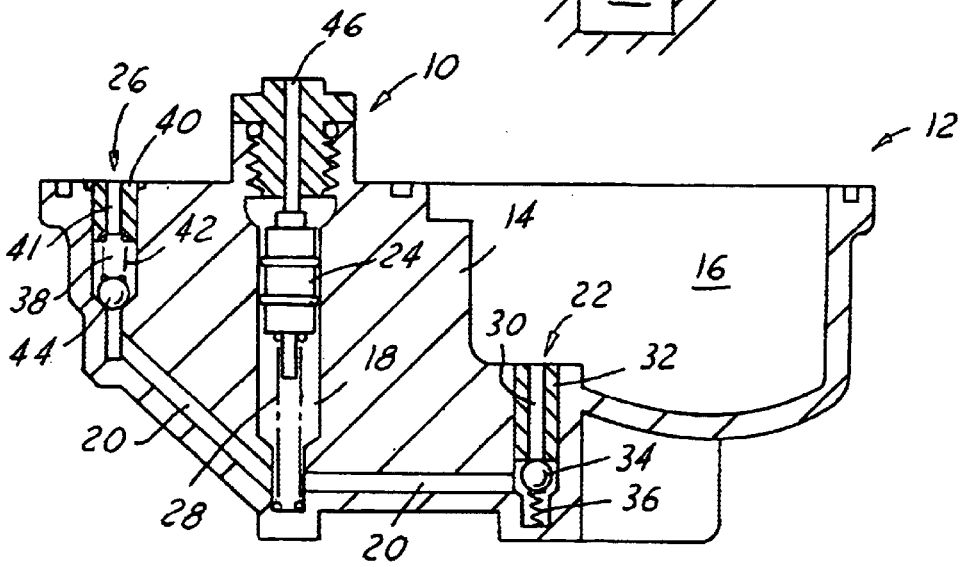
(PRIOR ART) FIG. 7

ACCELERATION FUEL PUMP HAVING A RESILIENT CHECK VALVE MEMBER FOR A COMBUSTION ENGINE CARBURETOR

REFERENCE TO RELATED APPLICATION

Applicant claims priority of Japanese Patent Application Serial No. 2001-149,268, filed May 18, 2001.

TECHNICAL DESCRIPTION

The present invention relates to a carburetor and more particularly to an acceleration fuel pump of a float-type carburetor for a combustion engine.

BACKGROUND OF THE INVENTION

Carburetors for combustion engines are known to have acceleration fuel pumps designed to enrich a fuel-and-air mixture for combustion during acceleration of an engine. Referring to FIG. 7, an acceleration fuel pump 10 of a known float-type carburetor 12 has a body 14 with a float chamber 16. The acceleration pump 10 has a primary machined cylindrical bore 18 carried by the body 14 which intersects a fuel passage 20 that communicates between the float or fuel chamber 16 and a carburetor fuel-and-air mixture passage that typically extends between an air intake filter and the combustion chamber or crankcase of an engine, not shown.

A variable volume fuel reservoir portion of the primary bore 18 is disposed below a reciprocating plunger 24 disposed within the bore 18 and sealably engaging the cylindrical wall. Fuel is drawn into the reservoir portion of the bore 18 from an upstream side of the fuel feed passage 20 when the plunger 24 begins to retract out of the primary bore 18 causing the reservoir portion to enlarge which draws fuel into the reservoir from an upstream side of the fuel feed passage 20. Passage 20 communicates with the fuel chamber 16 of the carburetor 12 through a normally closed inlet check valve 22 disposed in the feed passage and adjacent to the fuel chamber 16 and a normally closed outlet check valve 26 disposed in a downstream side of the feed passage 20. Fuel is drawn into the reservoir by retraction or upward movement of the plunger 24 caused by the force of a compressed spring 28 disposed between the bottom of the plunger 24 and the bottom of the bore 18 and creates a vacuum or subatmospheric pressure which draws or causes fuel to flow into the bore 18. When the running engine begins an acceleration period, a rod 46 engaged to the top of the plunger 24 pushes or advances the plunger against the force of the resilient spring 28 into the fuel filled bore 18. The inlet check valve 22 closes and the outlet check valve 26 opens so that fuel from the reservoir is pushed or flows through the downstream side of the fuel feed passage 20 through the open outlet check valve 26 and into the fuel-and-air mixing passage. When the acceleration of the engine is complete, the spring 28 once again causes the plunger 24 to retract in the bore 18 causing fuel from the fuel chamber 16 to once again fill the expanding reservoir portion of the bore 18.

The inlet check valve 22 has a sleeve 32 press fitted into a machined cylindrical bore in a cavity of the carburetor body 14. The sleeve 32 has a through bore 30 with a seat against which a metallic sphere or ball bearing 34 is forced by a compressed coil spring 36 to bias the check valve 22 closed. The fuel pressure in the upstream side of the bore 30 must be sufficiently greater than the fuel pressure within the primary bore 18 for the net hydraulic force to move the ball 34 away from the seat of the sleeve 32 permitting fuel to flow through the fuel feed passage 20 into the primary bore 18.

The outlet check valve 26 also has a sleeve 40 press fitted into a machine bore 41. However, unlike the inlet check valve 22, a ball bearing 44 is forced against a seat carried by the carburetor body 14 within the bore 41 and below the sleeve 40. When the ball bearing 44 is received on the seat, the check valve 26 is closed and fuel flow into the fuel-and-air mixing passage from the feed passage 20 or air flow into the feed passage 20 from the fuel-and-air mixing passage is blocked. A compression spring 42 is disposed between the sleeve 40 and the ball bearing 44 to yieldably urge the ball bearing against the body seat. During acceleration of the engine and as the plunger 24 is inserted further into the bore 18 the fuel pressure within the fuel feed passage 20 increases moving the ball 44 of the outlet check valve 26 upward and away from the seat against the force of the spring 42 so that fuel can flow into the fuel-and-air mixing passage of the carburetor. When the outlet check valve 26 is open, the inlet check valve 22 remains closed via the ball bearing 34 so that reverse air and/or fuel flow back into the fuel chamber 16 of the carburetor does not occur.

Unfortunately, the construction of the check valves 22, 26 requires additional machining of the carburetor body 14 and requires many component parts which increases manufacturing costs. In addition, dirt and debris can cause malfunction of either check valve which can degrade the efficiency or cause malfunction of the acceleration pump 10.

SUMMARY OF THE INVENTION

An acceleration fuel pump of a carburetor for combustion engine is part of the carburetor body and provides an additional flow of fuel to the fuel-and-air mixing passage of the carburetor during acceleration of the engine. The acceleration fuel pump has a plunger which inserts sealably into a cylindrical cavity carried by the body of the carburetor. During acceleration of the engine, the plunger inserts further into the cavity against the resilient force of a spring and toward a resilient check valve member causing the member to deform or expand into a fuel feed state. A fuel feed passage which extends between the bottom of a fuel chamber of the carburetor and the fuel-and-air mixing passage of the carburetor is intersected by the cavity and the resilient check valve member.

A leading portion of the resilient valve member has a slit which opens when the member is in the fuel feed state permitting fuel, displaced by the plunger, to flow out of a fuel reservoir carried by the cavity and into an outlet leg of the fuel feed passage which supplies fuel to the fuel-and air-mixing passage. During insertion of the plunger, pressure within the fuel reservoir overcomes the pressure within the upstream side or inlet leg of the fuel feed passage causing a trailing segment of the member to expand radially outward and engage the internal cylindrical wall of the cavity preventing any reverse flow from the fuel reservoir and into the inlet leg of the fuel passage which extends from the cavity to the fuel chamber. When the engine is done accelerating, insertion of the plunger terminates or has stopped and the internal spring forces the plunger to retract in an outward direction from the cavity. This retraction causes a pressure reduction within the fuel reservoir causing the slit of the leading segment of the check valve member to close and the peripheral rim of the trailing segment to separate or space from the cylindrical wall of the cavity. Fuel then is drawn from the fuel chamber through the inlet leg of the fuel passage into the fuel reservoir in preparation for the next acceleration period of the combustion engine.

Objects, features and advantages of this invention includes an acceleration fuel pump which is significantly impervious to dirt and debris, has a greatly reduced number of parts, requires less machining during manufacturing and may be readily incorporated into existing acceleration fuel pump designs. Additional advantages are improved acceleration of the engine, a relatively simple design and economical manufacture and assembly and in service a significantly increased useful life.

BRIEF DESCRIPTION OF DRAWINGS

These and other objects, features and advantages of this invention will be apparent from the following detailed description of the preferred embodiments and best mode, appended claims and accompanying drawings in which:

FIG. 1 is a fragmentary cross section view of a carburetor illustrating an acceleration fuel pump of the present invention;

FIG. 2 is an enlarged partial cross section view of the acceleration fuel pump taken from FIG. 1;

FIG. 7 is a fragmentary cross section view of a carburetor illustrating a known acceleration fuel pump.

DETAILED DESCRIPTION OF THE PREFERRED EMBODIMENTS

Figure 3:
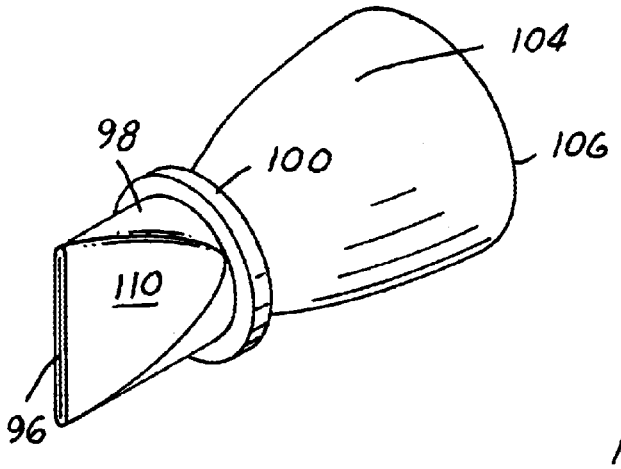
FIG. 3 is a perspective view of a resilient check valve member of the acceleration pump.
Figure 4:
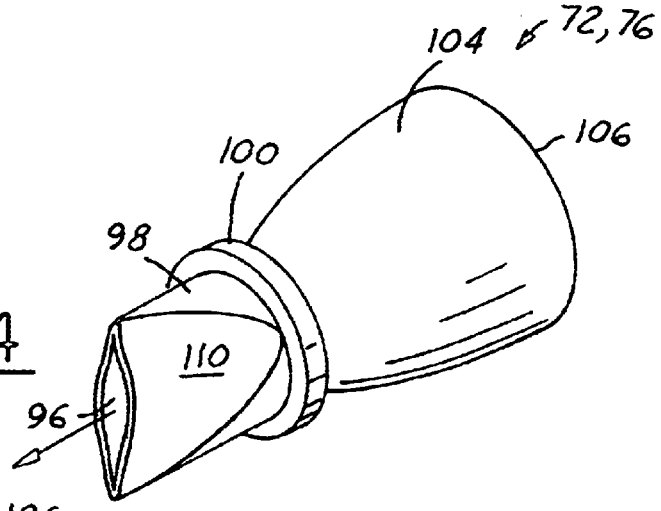
FIG. 4 is a perspective view of the check valve member in a fuel feed state.
Figure 5:
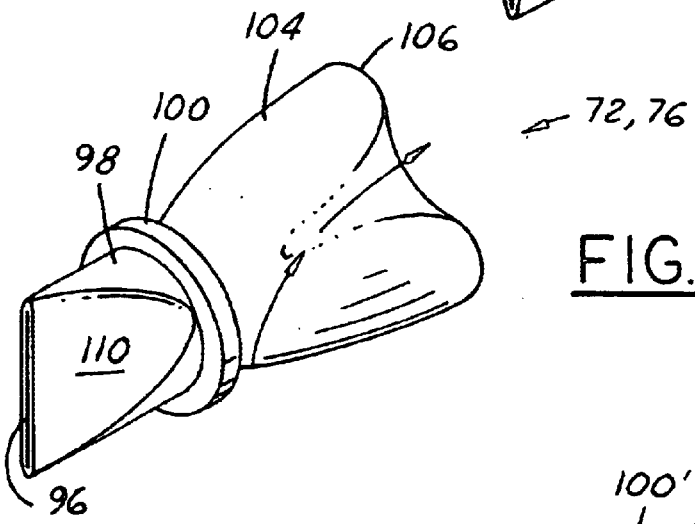
FIG. 5 is a perspective view of the check valve member illustrated in an exaggerated fuel draw state.

Referring to FIGS. 1 and 2, an acceleration fuel pump 50 of the present invention is shown as an integral part of a combustion engine carburetor 52 which is preferably of a float-type design. The acceleration fuel pump 50 is formed into a housing or body 54 of the carburetor 52 which also has a float-type fuel chamber 56. An acceleration fuel feed passage 58 flows fuel from the bottom of the fuel chamber 56 to an acceleration fuel feed nozzle disposed within a fuel-and-air mixing passage of the carburetor 52 that supplies a fuel-and-air mixture to the combustion chamber of a running engine, not shown. Intersecting the fuel feed passage 58 into an inlet leg 60 and an outlet leg 62 is a substantially cylindrical cavity 64. Extending downward into the cavity is a reciprocating plunger 66 which slideably seals against the substantially cylindrical interior wall or face 68 of the cavity 64 via two sealing rings or O-rings 70. Defined within the cavity 64 between the bottom of the plunger 66 and a resilient check valve member 72 is a fuel acceleration reservoir 74. The inlet leg 60 of the fuel feed passage communicates with the fuel reservoir 74 when the check valve member 72 is in a fuel draw or intake state 76. During this time, the fuel outlet leg 62 of the fuel feed passage 54 is isolated from the fuel reservoir 74 by the valve member 72. However, when the check valve member 72 is in a fuel feed or discharged state 78 the outlet leg 62 communicates with the fuel reservoir 74 and the inlet leg 60 is isolated therefrom, via the check valve member 72.

The cavity 64 has and extends into the body 54 from a counter bore 80 to a smaller diameter bottom bore 82 disposed concentrically thereto. The outlet leg 62 of the fuel feed passage 58 extends between a fuel feed port or nozzle opening into the carburetor mixing passage and an outlet port 84 disposed on the interior wall 68 of the cavity 64 at the bottom bore 82. The inlet leg 60 extends between the bottom of the fuel chamber 56 and an inlet port 86 disposed in the interior wall 68 at an intermediate chamber 88 of the counter bore 80. The intermediate chamber 88 is defined radially between the check valve member 72 and the interior wall 68. Preferably, the fuel reservoir 74 is disposed at or below the bottom of the fuel chamber 56 so that fuel flow, caused by gravity, will assure the intermediate chamber 88 contains fuel. This will assist in filling the fuel reservoir 74 with fuel after engine acceleration and during plunger 66 retraction.

During and to achieve smooth acceleration of the engine, an enriched mixture of fuel and air is delivered to the combustion chamber via the carburetor 52. A rod 90 extending through a threaded plug 89, engaged to the interior wall 68 at the top of the counter bore 80 and sealed therebetween via gasket or O-ring 91, is engaged concentrically to the top of the plunger 66 and pushes the plunger 66 into the counter bore 80 during acceleration. The plunger insertion is achieved against the compressive axial force of a compressed coil spring 92 mounted concentrically within the counter bore 80 between the bottom of the plunger 66 and a spring seat 94 defined by the interior surface 68 and extending circumferentially and radially outward from the counter bore 80 above the intermediate chamber 88 and the check valve member 72.

Referring to FIGS. 1–4, during plunger insertion, the fuel reservoir 74 is reduced in volume forcing the reservoir fuel in to be discharged through a slit 96 of a substantially duck bill portion 98 of the check valve member 72. The duck bill portion 98 extends downward from a flange or intermediate flange portion 100 of the valve member 72 which extends radially circumferentially outward and in assembly seals against an upward facing annular shelf or shoulder 102 of the interior wall 68, which is disposed between the counter bore 80 and the bottom bore 82. When the slit 96 is open, the check valve member is in the fuel feed state 78. In this state, a substantially funnel shaped trailing portion 104 expands radially outward due to the pressure increase within the fuel reservoir 74, and when this pressure becomes greater than the fuel pressure within the intermediate chamber 88. As a result, a trailing peripheral edge or rim 106 of the trailing portion 104 sealably engages a cylindrical surface 105 of the interior wall 68 which radially defines the counter bore 80. The inlet port 86 and the intermediate chamber 88 are thereby segregated or sealed-off from the fuel reservoir 74, and reverse fuel flow back into the fuel chamber 56 is prevented.

After engine acceleration, the spring 92 pushes upward against the plunger 66 retracting the plunger from the counter bore 80. During retraction, the reservoir 74 volume increases and the pressure consequently decreases below the fuel pressure contained within the intermediate chamber 88. The peripheral rim 106 of the trailing portion 104 shrivels or moves radially inward and separates from the interior wall 68 and fuel flows from the fuel chamber 56 through the inlet leg 60 of the fuel feed passage 58 through the intermediate chamber 88 and into the expanding reservoir 74. When the check valve member 72 is in this fuel draw state 76, the decrease of pressure within the reservoir 74 causes the slit 96 to close via the resilient force of the check valve member 72 itself. With the slit 96 closed and the flange 100 sealed against the annular shelf or shoulder 102 of the interior wall 68, the outlet leg 62 of the fuel feed passage 58 and the bottom bore 82, are segregated and sealed-off from the fuel reservoir 74. The flange 100 is held against the shelf 102 by a retaining ring 108 press fitted into the counter bore 80 and which axially compresses the flange 100 against the shoulder 102 within the intermediate chamber 88.

The fuel reservoir 74 is defined substantially radially between an interior surface 109 of the check valve member 72 which is generally convex in shape and the cylindrical wall 68 of the cavity 64 at the counter bore 80 above the valve member 72.

Referring to FIG. 3, the slit 96 is substantially linear and the leading duck bill portion 98 of the check valve member 72 has two substantially opposite planar surfaces 110 each lying within an imaginary plane that generally converge upon one another along the slit 96 location. The planar surfaces 110 permit relative easy opening of the slit 96 without creating a flutter action of the resultant opening.

Figure 6:
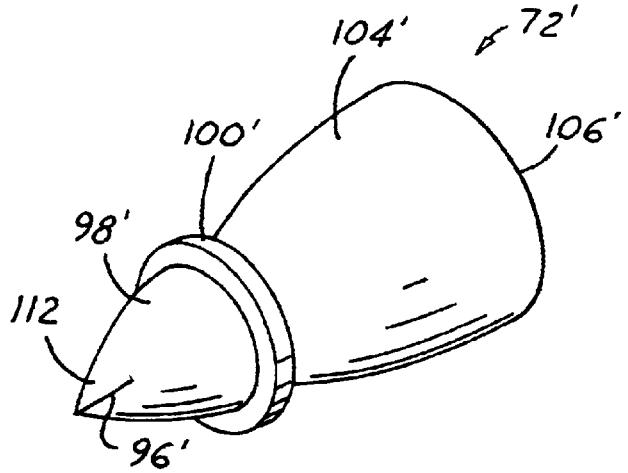
FIG. 6 is a second embodiment of a resilient check valve member.

Referring to FIG. 6, a second embodiment of a resilient check valve member 72' is illustrated. Unlike the first embodiment, member 72' has a conical leading portion 98' which projects from a flange 100' to a distal tip 112. A slit 96' traverses the tip 112 go that two substantially equal lengths of the slit 96' are diametrically opposed from the tip 112.

While the forms of the invention herein disclosed constitute presently preferred embodiments, many others are possible. It is not intended herein to mention all the possible equivalent forms or ramifications of the invention. It is further understood that the terms used herein are merely descriptive rather than limiting, in that various changes may be made without departing from the spirit and scope of this invention as defined by the following claims.

In the claims:

1. An acceleration fuel pump for a carburetor comprising:

a body;

a reservoir carried by the body;

a fuel feed passage carried by the body, the fuel feed passage having a fuel inlet leg and a fuel outlet leg communicating with the inlet leg via the reservoir;

a resilient check valve member disposed within the body and obstructing communication between the inlet leg, the outlet leg and the reservoir, the member having a fuel feed state, a fuel draw state, a leading portion having a slit, a trailing portion, and an intermediate flange portion disposed axially between the leading and trailing portions and projecting radially outward for sealable engagement to the body thus isolating the reservoir from the outlet leg when the slit is closed, and an interior surface facing radially inward and formed by the leading, intermediate flange and trailing portions for defining in-part the reservoir;

wherein the slit is open so that the reservoir communicates with the outlet leg and the trailing portion resiliently seals against the body to isolate the inlet leg from the reservoir when the member is in the fuel feed state;

wherein the slit is closed so that the reservoir is isolated from the outlet leg via the leading portion and the trailing portion is spaced from the body so that the inlet leg communicates with the reservoir when the member is in the fuel draw state; and wherein the trailing portion is sealed tangentially to a cylindrical surface formed by the body when the member is in the fuel feed state.

2. The acceleration fuel pump set forth in claim 1 comprising a peripheral rim of the trailing portion of the check valve member being sealed to the body thus isolating the inlet leg from the outlet leg when the member is in the fuel feed state.

3. The acceleration fuel pump set forth in claim 2 wherein the leading portion is cup-shaped and is disposed concentrically to the trailing portion which is ring-shaped.

4. The acceleration fuel pump set forth in claim 3 comprising:

an elongated blind cylindrical cavity defined radially by an interior wall, the fuel reservoir being part of the cylindrical cavity; and a plunger disposed within the cylindrical cavity, the fuel reservoir defined axially between the plunger and the member, the plunger constructed and arranged to be in sealing relation with the interior wall as the plunger moves axially toward the member placing the member in the fuel feed state, or as the plunger retracts axially away from the member placing the member in the fuel draw state.

5. The acceleration fuel pump set forth in claim 4 comprising:

the cylindrical cavity having a bottom bore and a counter bore disposed concentrically above the bottom bore;

an annular shelf of the interior wall disposed axially between the bottom bore and the counter bore; and the member having a sealing intermediate flange portion projecting radially outward and disposed between the leading and trailing portions, wherein the intermediate flange portion is sealed to the annular shelf.

6. An acceleration fuel pump for a carburetor comprising:

a body;

a reservoir carried by the body;

a fuel feed passage carried by the body, the fuel feed passage having a fuel inlet leg and a fuel outlet leg communicating with the inlet leg via the reservoir;

a resilient check valve member disposed within the body and obstructing communication between the inlet leg, the outlet leg and the reservoir, the member having a fuel feed state, a fuel draw state, a leading portion having a slit, and a trailing portion;

wherein the slit is open so that the reservoir communicates with the outlet leg and the trailing portion resiliently seals against the body to isolate the inlet leg from the reservoir when the member is in the fuel feed state;

wherein the slit is closed so that the reservoir is isolated from the outlet leg via the leading portion and the trailing portion is spaced from the body so that the inlet leg communicates with the reservoir when the member is in the fuel draw stare;

a peripheral rim of the trailing portion of the check valve member being sealed to die body thus isolating the inlet leg from the outlet leg when the member is in the fuel feed state;

an interior surface of the check valve member defining in-part the reservoir and carried by the leading and trailing portions;

wherein the leading portion is cup-shaped and is disposed concentrically to the trailing portion which is ring-shaped;

an elongated blind cylindrical cavity defined radially by an interior wall, the fuel reservoir being part of the cavity;

a plunger disposed within the cavity, the fuel reservoir defined axially between the plunger and the member, the plunger constructed and arranged to be in sealing relation with the interior wall as the plunger moves axially toward the member placing the member in the fuel feed state, or as the plunger retracts axially away from the member placing the member in the fuel draw state;

the cylindrical cavity having a bottom bore, a counter bore and an annular shelf disposed axially between the bottom bore and the counter bore;

the member having a sealing flange projecting radially outward and disposed between the leading and trailing portions, wherein the flange is sealed to the annular shelf; and a separate retaining ring press fitted within the counter bore and engaged circumferentially to the flange of the member.

7. The acceleration fuel pump set forth in claim 6 comprising:

a spring seat carried by a cylindrical surface of the interior wall which defines the counter bore; and a spring engaged axially between the spring seat and the plunger, the spring constructed and arranged to retract the plunger.

8. The acceleration fuel pump set forth in claim 6 comprising an annular intermediate chamber defined radially between the trailing portion of the member and the wall at the counter bore, the fuel inlet leg being in communication with the intermediate chamber when the member is in the fuel feed state and in the fuel draw state.

9. The acceleration fuel pump set forth in claim 8 wherein the peripheral rim of the trailing portion of the member expands radially outward and is thus biased sealably against the wall at the counter bore when the fuel pressure within the reservoir is greater than the fuel pressure within the intermediate chamber.

10. The acceleration fuel pump set forth in claim 9 wherein the peripheral rim of the trailing portion of the member is spaced from the wall at the counter bore when the member is in the fuel draw state and the fuel pressure within the intermediate chamber is greater than the fuel pressure within the reservoir.

11. The acceleration fuel pump set forth in claim 1 which also comprises a cylindrical cavity defined by a face carried by the body, the reservoir being part of the cavity;

a fuel inlet port carried by the face;

a fuel outlet port carried by the face;

a plunger constructed and arranged to sealably extend into and retract out of the cylindrical cavity; and the resilient check valve member being disposed within the cylindrical cavity, the member having a concave interior surface carried by the leading, trailing, and intermediate flange portions, wherein the leading portion is semi-conical ring-shaped and is disposed concentrically to the intermediate flange portion and trailing portion, the reservoir being defined at least in part by the interior surface of the member, the face of the cylindrical cavity and the plunger, and wherein the intermediate flange portion is engaged continuously circumferentially to the face of the cavity axially between the inlet and outlet ports.

12. The acceleration fuel pump set forth in claim 11 wherein the cylindrical cavity has a counter bore and a bottom bore, the leading portion of the member projecting axially into the bottom bore and the trailing portion being disposed in the counter bore.

13. An acceleration fuel pump for a carburetor comprising:

a body;

a reservoir carried by the body;

a fuel feed passage carried by the body, the fuel feed passage having a fuel inlet leg and a fuel outlet leg communicating with the inlet leg via the reservoir;

a resilient check valve member disposed within the body and obstructing communication between the inlet leg, the outlet leg and the reservoir, the member having a fuel feed state, a fuel draw state, a leading portion having a slit, and a trailing portion;

wherein the slit is open so that the reservoir communicates with the outlet leg and the trailing portion resiliently seals against the body to isolate the inlet leg from the reservoir when the member is in the fuel feed state;

wherein the slit is closed so that the reservoir is isolated from the outlet leg via the leading portion and the trailing portion is spaced from the body so that the inlet leg communicates with the reservoir when the member is in the fuel draw state;

a cylindrical cavity carried by the body and defined by a face, the reservoir being part of the cavity;

a fuel inlet port carried by the cylindrical face;

a fuel outlet port carried by the cylindrical face;

a plunger constructed and arranged to sealably extend into and retract out of the cavity;

the resilient check valve member being disposed within the cylindrical cavity, the member having a concave interior surface carried by the leading and trailing portions, wherein the leading portion is semi-conical ring-shaped and is disposed concentrically to the trailing portion, the reservoir being defined at least in part by the interior surface of the member, the face of the cylindrical cavity and the plunger, and wherein the trailing portion is engaged continuously circumferentially to the face of the cavity axially between the inlet and outlet ports;

wherein the cylindrical cavity has a counter bore and a bottom bore, the leading portion of the member projecting axially into the bottom bore and the trailing portion being disposed in the counter bore;

the face having an annular shelf carried between the counter bore and the bottom bore; and the member having a flange disposed axially between and concentrically to the leading and trailing portions, the flange projecting radially outward and being engaged circumferentially to the annular shelf.

14. The acceleration fuel pump set forth in claim 13 wherein the resilient member is rubber.

15. The acceleration fuel pump set forth in claim 13 wherein the resilient member is synthetic rubber.

16. The acceleration fuel pump set forth in claim 1 comprising:

the trailing portion of the check valve member being funnel shaped;

a counter bore defined by the cylindrical surface formed by the body; and a peripheral rim of the funnel shaped trailing portion being sealed to the cylindrical surface when the member is in the fuel feed state thus isolating the inlet leg from the outlet leg.

17. An acceleration fuel pump for a carburetor having a fuel-and-air mixing passage and a fuel chamber defined by a body, the acceleration fuel pump comprising:

an elongated blind cavity defined by the body, the cavity having a reservoir;

a fuel feed passage carried by the body, the fuel feed passage having a fuel inlet leg communicating between the reservoir and the fuel chamber, and a fuel outlet leg communicating between the reservoir and the fuel-and-air mixing passage;

a resilient check valve member disposed within the cavity and obstructing communication between the inlet leg, the outlet leg and the reservoir, the member having a fuel feed state, a fuel draw state, a leading portion having a slit, and a trailing portion;

a plunger disposed within the cavity, the fuel reservoir defined axially between the plunger and the member;

a compression spring disposed in the reservoir for biasing the plunger into the fuel draw state;

wherein the compression spring is compressed resiliently against the plunger when the plunger is in the fuel feed state;

wherein the slit is open so that the reservoir communicates with the outlet leg and the trailing portion resiliently seals against the body to isolate the inlet leg from the reservoir when the member is in the fuel feed state;

wherein the slit is closed so that the reservoir is isolated from the outlet leg via the leading portion and the trailing portion is spaced from the body so that the inlet leg communicates with the reservoir when the member is in the fuel draw state;

an intermediate chamber of the counter bore defined radially inward by and disposed concentrically to the trailing portion; and wherein the intermediate chamber is in constant communication with the fuel inlet leg and communicates with the reservoir when the member is in the fuel draw state.

18. The acceleration fuel pump set forth in claim 17 wherein the reservoir and the intermediate chamber are disposed at a lower elevation than the fuel chamber enabling fuel to enter the intermediate chamber via gravity flow.

* * * * *